US009400442B2

(12) United States Patent
Kaneko et al.

(10) Patent No.: US 9,400,442 B2
(45) Date of Patent: Jul. 26, 2016

(54) IMAGE FORMING APPARATUS

(71) Applicants: Satoshi Kaneko, Kanagawa (JP); Shinji Kato, Kanagawa (JP); Shuji Hirai, Tokyo (JP)

(72) Inventors: Satoshi Kaneko, Kanagawa (JP); Shinji Kato, Kanagawa (JP); Shuji Hirai, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/802,322

(22) Filed: Jul. 17, 2015

(65) Prior Publication Data

US 2016/0062260 A1 Mar. 3, 2016

(30) Foreign Application Priority Data

Sep. 2, 2014 (JP) ..... 2014-177745

(51) Int. Cl.
*G03G 15/02* (2006.01)

(52) U.S. Cl.
CPC ..... *G03G 15/0266* (2013.01)

(58) Field of Classification Search
CPC ... G03G 5/0614; G03G 5/0696; G03G 5/142; G03G 5/047; G03G 5/0517; G03G 5/0521; G03G 2215/00957; G03G 5/051; G03G 5/0514; G03G 5/144; G03G 5/0609; G03G 15/5037; G03G 5/0525; G03G 5/0564
See application file for complete search history.

(56) References Cited

U.S. PATENT DOCUMENTS

2012/0201552 A1 8/2012 Hirai et al.
2013/0108288 A1* 5/2013 Kaneko ..... G03G 15/5058 399/43
2013/0108292 A1 5/2013 Suzuki et al.
2013/0230332 A1* 9/2013 Ishii ..... G03G 15/556 399/27
2013/0243456 A1 9/2013 Kaneko et al.
2013/0243457 A1 9/2013 Kaneko et al.
2014/0169814 A1 6/2014 Uematsu et al.
2014/0268242 A1 9/2014 Kaneko et al.
2014/0270827 A1 9/2014 Muto et al.
2014/0270828 A1 9/2014 Suzuki et al.
2014/0301748 A1 10/2014 Suzuki et al.

FOREIGN PATENT DOCUMENTS

JP 2000-098675 4/2000
JP 2002-207350 7/2002
JP 2013-024940 2/2013

OTHER PUBLICATIONS

U.S. Appl. No. 14/619,387, filed Feb. 11, 2015, Satoshi Kaneko, et al.
U.S. Appl. No. 14/726,847, filed Jun. 1, 2015, Satoshi Kaneko, et al.

* cited by examiner

*Primary Examiner* — Roy Y Yi
(74) *Attorney, Agent, or Firm* — Oblon, McClelland, Maier & Neustadt, L.L.P.

(57) ABSTRACT

An image forming apparatus includes a latent image carrier; a charger; a charging power supply; a latent image writer to write; a developing device; a rotary attitude sensor; a controller to perform a data formulating process to formulate a change pattern data and a bias changing process to cause the charging power supply to change the charging bias output based on readings from the rotary attitude sensor and the change pattern data, during a print job; and a surface potential sensor to detect a surface potential of the latent image carrier. In the data formulating process, the controller formulates the change pattern data based on the surface potential of the latent image carrier detected by the surface potential sensor, while the charging power supply outputting a constant charging bias, and based on readings from the rotary attitude sensor while the surface potential is being detected.

9 Claims, 8 Drawing Sheets

IMAGE FORMING APPARATUS

CROSS-REFERENCE TO RELATED APPLICATION

The present application claims priority pursuant to 35 U.S.C. §119 from Japanese patent application number 2014-177745, filed on Sep. 2, 2014, the entire disclosure of which is incorporated by reference herein.

BACKGROUND

1. Technical Field

The present invention relates to an image forming apparatus that changes the output bias voltage from a charging power supply to change an output amount of bias voltage, based on readings from a rotary attitude sensor to detect whether or not a charger that charges a surface of a latent image carrier assumes a predetermined rotary attitude, and on predetermined change pattern data.

2. Background Art

A conventional image forming apparatus includes a photoconductor as a latent image carrier, a charging roller rotating while contacting the photoconductor, a charging power supply to output bias voltage to be applied to the charging roller, a latent image writing device, and a developing device. An electrostatic latent image is written on a surface of the photoconductor that is uniformly charged by the charging roller, and the electrostatic latent image is then developed by the developing device, thereby obtaining a toner image. In such a structure, the charging roller serving as a charger having variations in the resistance on a peripheral surface of the roller, causes a charged surface of the photoconductor to be varied and image density of the formed image to be varied. In particular, because a gray scale portion such as a highlight portion or a halftone portion tends to be affected by the charged potential of the photoconductor relative to the image density, the aforementioned image density fluctuation worsens.

For the purpose of decreasing the image density fluctuation, the charging roller may be kept away from the photoconductor and allowed to contact a conductive roller. After the charging roller starts rotation, the attitude of the charging roller is detected by a rotary attitude sensor, and if it is detected that the charging roller assumes a predetermined rotary attitude, a predetermined bias voltage is applied to the charging roller. Then, variations in the electrical resistance of one cycle of the charging roller are obtained based on a change in current strength flowing between the charging roller and the conductive roller. After completion of the fluctuation resistance detection, bias change pattern data corresponding to one cycle of the roller responsive to the variations in the resistance is generated. Then, if a print job is started with the charging roller contacting the photoconductor, the photoconductor is charged while changing output from the charging power supply according to the previously-generated bias change pattern data. By reducing the fluctuation of the charged surface of the photoconductor due to the variations in the resistance of the charging roller, image density fluctuation can be prevented from occurring.

SUMMARY

One embodiment of the present invention provides an optimal image forming apparatus including a latent image carrier; a charger to charge, while rotating, a surface of the latent image carrier; a charging power supply to output bias voltage to be applied to the charger; a latent image writer to write a latent image on the surface of the latent image carrier charged by the charger; a developing device to develop the latent image to obtain a toner image; a rotary attitude sensor to detect whether or not the charger assumes a predetermined rotary attitude; a controller to perform, at a predetermined timing, a data formulating process to formulate a change pattern data as a bias change data table to cause the charging power supply to change an charging bias output by a predetermined pattern, and to perform a bias changing process to cause the charging power supply to change the charging bias output based on readings from the rotary attitude sensor and the change pattern data, during a print job; and a surface potential sensor to detect a surface potential of the latent image carrier. In the data formulating process, the controller formulates the change pattern data based on the surface potential at a plurality of positions of the latent image carrier in the rotary direction detected by the surface potential sensor, while the charging power supply outputting a constant charging bias, and based on readings from the rotary attitude sensor while the surface potential is being detected.

These and other objects, features, and advantages of the present invention will become apparent upon consideration of the following description of the preferred embodiments of the present invention when taken in conjunction with the accompanying drawings.

DETAILED DESCRIPTION

Preferred embodiments of a full-color copier (hereinafter, simply a copier) employing an electrophotographic method, as an image forming apparatus to which the preferred embodiments are applied, will be described.

Figure 1:
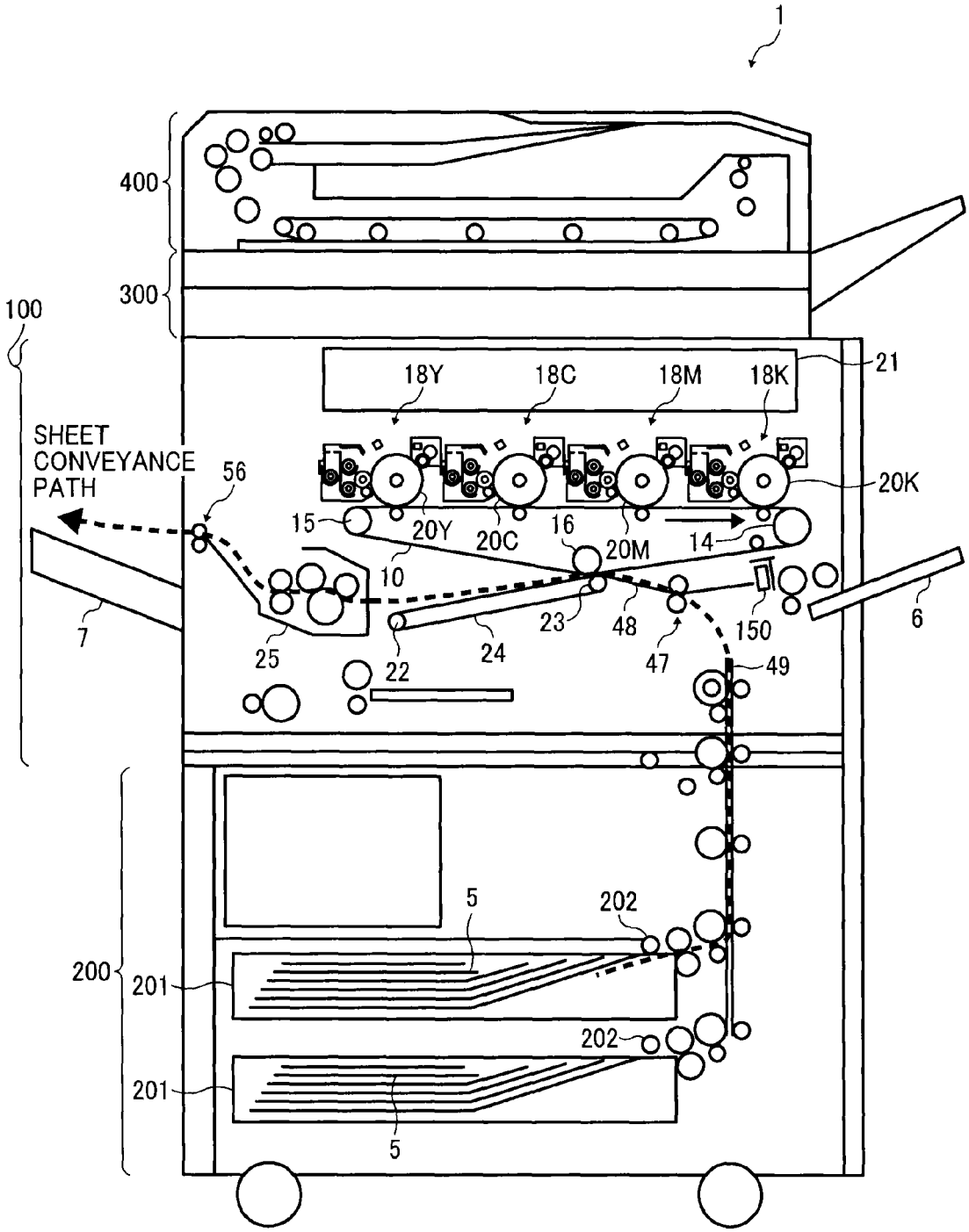
FIG. 1 schematically illustrates a copier according to an embodiment of the present invention.

FIG. 1 schematically illustrates a basic structure of the copier 1 according to an embodiment of the present invention. As illustrated in FIG. 1, the copier 1 includes an image forming section 100 to form an image on a recording sheet 5, a sheet feed device 200 to supply the recording sheet 5 to the image forming section 100, and a scanner 300 to read the image in an original. In addition, an automatic document feeder (ADF) 400 is disposed on an upper part of the scanner 300. The image forming section 100 includes a manual tray 6 to set the recording sheet 5 manually, and a stack tray 7 to stack the recording sheet 5 on which the image has been formed.

Figure 2:
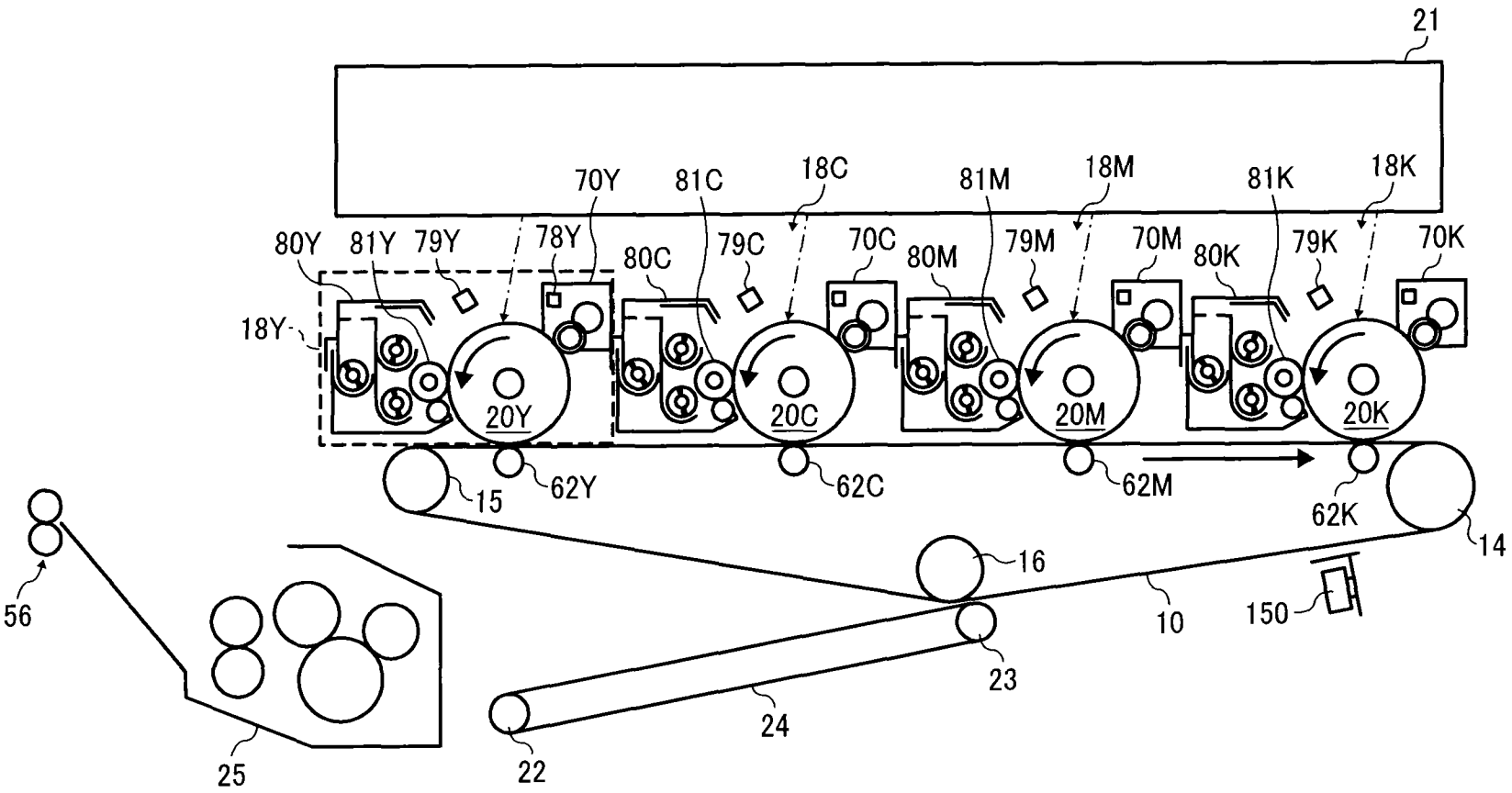
FIG. 2 is an enlarged view illustrating an image forming section of the copier of FIG. 1.

FIG. 2 is an enlarged view illustrating the image forming section 100 of FIG. 1. An intermediate transfer belt 10 is an endless belt serving as a transfer member and is disposed on the image forming section 100. The intermediate transfer belt 10 endlessly moves in a clockwise direction while being stretched around three support rollers 14, 15, and 16, one roller of which rotatably drives the intermediate transfer belt 10. In addition, four image forming units corresponding to the colors of yellow (Y), cyan (C), magenta (M), and black (K) are disposed opposite an outer surface of the intermediate transfer belt 10 moving between a first support roller 14 and a second support roller 15 among the support rollers 14, 15, and 16. An optical sensor unit 150 to detect an image density (that is, toner adhesion amount per unit area) of a toner image formed on the intermediate transfer belt 10 is disposed opposite the outer surface of the intermediate transfer belt 10 moving between the second support roller 15 and a third support roller 16.

As illustrated in FIG. 1, a laser writer 21 is disposed above image forming units 18Y, 18C, 18M, and 18K. The laser writer 21 includes a laser controller that drives a semiconductor laser to emit light to write an image based on image data of the original read by a scanner 300. The emitted light exposes and scans a surface of drum-shaped photoconductors 20Y, 20C, 20M, and 20K, each being a latent image carrier disposed in each of the image forming units 18Y, 18C, 18M, and 18K, thereby forming an electrostatic latent image on the photoconductors. The present optical sensor unit 150 employs a laser diode as a light source, but may employ a light-emitting diode (LED), for example.

Figure 3:
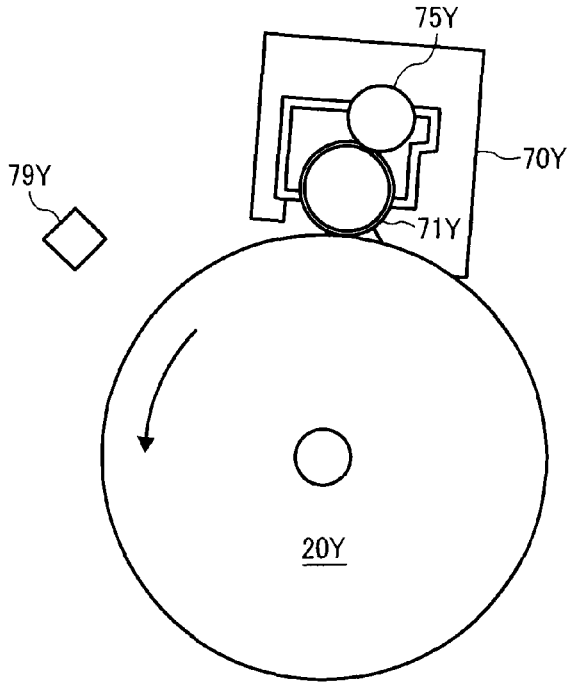
FIG. 3 is an enlarged view illustrating a photoconductor and a charger for Y-color in the image forming section of the copier of FIG. 1.

FIG. 3 is an enlarged view of the photoconductor 20Y and a charging device or a charger 70Y each for yellow color. Parts and components for the Y-color are described as a representative example. The charger 70Y includes a charging roller 71Y rotating while contacting the photoconductor 20Y, a charge cleaning roller 75Y rotating while contacting the charging roller 71Y, and a rotary attitude sensor 76Y (see FIG. 4) described later.

Figure 4:
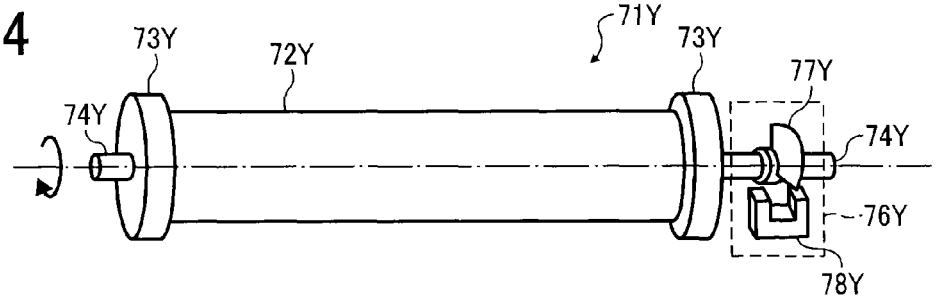
FIG. 4 is an enlarged perspective view illustrating a charging roller in the charger of FIG. 3.

FIG. 4 is an enlarged perspective view illustrating the charging roller 71Y. The charging roller 71Y includes a column-shaped main body 72Y, large-diameter portions 73Y disposed at both ends of the main body 72Y in a rotary shaft direction, and a rotary shaft 74Y rotatably supported by a shaft bearing, not shown. The main body 72Y is constructed of a column-shaped metal core, a conductive layer coating a surface of the metal core, and a surface layer coated on the conductive layer. In addition, the large-diameter portion 73Y molded to a disc shape having a diameter larger than that of the main body 72Y is formed of insulating materials. In addition, the rotary shaft 74Y is formed of metal materials and passes through the metal core of the main body 72Y. The thus-formed charging roller 71Y is pressed against the photoconductor 20Y via a biasing means, so that the two large-diameter portions 73Y at both ends of the charging roller 71Y in the rotary shaft direction contact the photoconductor 20Y. With this contacting, the charging roller 71Y can rotate together with the photoconductor 20Y. The main body 72Y having a diameter smaller than that of the large-diameter portion 73Y is situated across a minute gap with respect to the surface of the photoconductor 20Y. Electrical discharge occurs inside the minute gap, so that the surface of the photoconductor is uniformly charged. To generate such electrical discharge, a charging bias of a superimposed voltage in which a direct current voltage and an alternating voltage are superimposed is applied to the rotary shaft 74Y conducting to the metal core of the main body 72Y. The present charging roller 71Y includes the large-diameter portions, but the charging roller 71Y without the large-diameter portions may be used, in which the main body 72Y directly contacts the photoconductor 20Y.

One end of the rotary shaft 74Y that protrudes from an end of the large-diameter portion 73Y passes through the rotary attitude sensor 76Y, and the protruding portion is supported by a shaft bearing, not shown. The rotary attitude sensor 76Y includes a shield member 77Y secured to the rotary shaft 74Y and rotating together with the rotary shaft 74Y, and a transmission-type photosensor 78Y. The shield member 77Y has a shape protruding in a normal line direction at a predetermined peripheral portion of the rotary shaft 74Y. When the charging roller 71Y assumes a predetermined rotary attitude, the shield member 77Y comes between a light emitting element and a light receiving element of the transmission-type photosensor 78Y, so that when the light receiving element does not receive light, output voltage from the transmission-type photosensor 78Y greatly decreases. Specifically, the transmission-type photosensor 78Y detects whether or not the charging roller 71Y assumes a predetermined rotary attitude, and decreases the output voltage therefrom accordingly.

Figure 5:
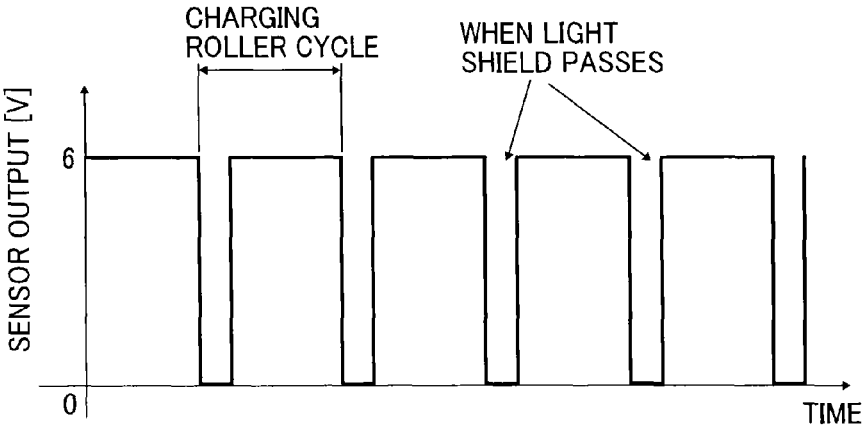
FIG. 5 is a graph showing a change over time in the output voltage from a rotary attitude sensor for Y-color in the charger of FIG. 3.

FIG. 5 is a graph showing a change over time in the output voltage from the rotary attitude sensor 76Y for Y-color. As illustrated in FIG. 5, when the charging roller 71Y rotates, a voltage of 6 volts is output from the rotary attitude sensor 76Y. However, each time the charging roller 71Y rotates once, the output voltage from the rotary attitude sensor 76Y drastically declines to near 0 volt instantaneously. This is because, each time the charging roller 71Y rotates once, the light receiving element does not receive light due to the shield member 77Y coming between the light emitting element and the light receiving element of the transmission-type photosensor 78Y. Specifically, when the charging roller 71Y assumes a predetermined rotary attitude, the output voltage greatly decreases.

Referring back to FIG. 3, the charge cleaning roller 75Y of the charger 70Y includes a conductive metal core and an elastic layer coated on the peripheral surface of the metal core. The elastic layer is formed of a sponge material formed by minutely foaming melamine resins and rotates while contacting the main body 72Y of the charging roller 71Y, so that dust such as residual toner adhered on the main body 72Y is removed therefrom, thereby preventing abnormal images from being generated.

Referring back to FIG. 2, the four image forming units 18Y, 18C, 18M, and 18K are configured to be substantially similar with each other, except that each of the image forming units 18Y, 18C, 18M, and 18K handles different color of toner. The image forming unit 18Y to form a Y-color toner image as an example includes the photoconductor 20Y, the charger 70Y, the surface potential sensor 79Y, and a developing device 80Y. The surface potential sensor 79Y detects a potential of the peripheral surface of the photoconductor 20Y in an area after passing through the portion opposite the charger 70Y and before entering into the portion opposite the developing device 80Y.

The surface of the photoconductor 20Y is uniformly charged at a negative polarity by the charger 70Y. Among the uniformly charged surface of the photoconductor 20Y, the electric potential of a part to which the laser light is emitted from the laser writer 21 is damped to form an electrostatic latent image.

The developing device 80Y employs two-component developer including magnetic carriers and non-magnetic toner and performs two-component developing method; however, the developing device 80Y may employ one-component developer excluding magnetic carriers. The developing device 80Y includes an agitator and a developing unit housed within a development case. In the agitator, the two-component developer (herein, the developer) is agitated by three screws and is conveyed to the developing unit. The developing unit includes a developing sleeve 81Y disposed opposite, via an opening of the development case, the photoconductor 20Y with a predetermined spacing in between. Part of the peripheral surface of the developing sleeve 81Y contacts the photoconductor 20Y while rotating. A magnet roller is fixed to the developing sleeve 81Y so as not to rotate together with the developing sleeve 81Y. The developer is supplied from the agitator to the developing unit and is scooped up by a magnetic force of the magnet roller onto a surface of the developing sleeve 81Y. The developer scooped up onto the surface of the developing sleeve 81Y is conveyed to a development area opposite the photoconductor 20Y. Before arriving at the development area, the developer is brought to a magnetic brush state by the magnetic force of the magnet roller. In the development area, the toner included in the developer is transferred onto the electrostatic latent image formed on the photoconductor 20Y by the development potential due to the developing bias applied to the developing sleeve 81Y. With this structure, the toner included in the developer is transferred onto the electrostatic latent image on the photoconductor 20Y, so that the electrostatic latent image is developed. As a result, Y-toner image is formed on the photoconductor 20Y. The Y-toner image enters into a primary transfer nip for Y-color accompanied by a rotation of the photoconductor 20Y.

The developer that has passed through the development area accompanied by the rotation of the developing sleeve 81Y is conveyed to an area where the magnetic force of the magnet roller attenuates, is separated from the surface of the developing sleeve 81Y, and returns to the agitator. The developer that has returned to the agitator is agitated by the three screws, and is again supplied to the developing unit. Before the developer is again supplied to the developing unit, the toner density of the developer is detected by a toner density sensor, and an amount of toner corresponding to a detection result is newly replenished. This replenishment is performed by the controller that drives a toner replenisher according to the detection result by the toner density sensor.

Heretofore, formation of a Y-toner image in the image forming unit 18Y for Y-color has been described, and the other C-color, M-color, and K-color toner images can be formed on each surface of the photoconductors 20C, 20M, and 20K via similar processes as the Y-color toner image, in each image forming unit 18C, 18M, or 18K for the colors of C, M, and K. Therefore, parts and components with suffixes of C, M, and K not explicitly described are included in the present copier 1 and operated similarly to those with a suffix of Y.

Primary transfer rollers 62Y, 62C, 62M, and 62K for Y, C, M, and K are disposed on an inner loop of the intermediate transfer belt 10. The intermediate transfer belt 10 is nipped or sandwiched by the primary transfer rollers 62Y, 62C, 62M, and 62K and the photoconductors 20Y, 20C, 20M, and 20K. With this nipping, the outer surface of the intermediate transfer belt 10 contacts each of the photoconductors 20Y, 20C, 20M, and 20K, respectively, thereby forming four primary transfer nips for Y-, C-, M-, and K-colors. When the primary transfer bias is applied, a primary electric field is formed between the primary transfer rollers 62Y, 62C, 62M, and 62K and the photoconductors 20Y, 20C, 20M, and 20K, respectively.

The outer surface of the intermediate transfer belt 10 sequentially passes the primary transfer nip for Y-, C-, M-, and K-color along an endless move of the belt. During such a process, Y-, C-, M-, and C-toner images on the photoconductors 20Y, 20C, 20M, and 20K are sequentially overlaid on the outer surface of the intermediate transfer belt 10 as a primary transfer. With this process, four-color overlaid toner image is formed on the outer surface of the intermediate transfer belt 10.

An endless conveyance belt 24 stretched over a first tension roller 22 and a second tension roller 23 is disposed below the intermediate transfer belt 10, and is driven to rotate in the counterclockwise direction according to a rotation of one of the tension rollers 22, 23. The outer surface of the conveyance belt 24 contacts the third support roller 16 at a portion where the intermediate transfer belt 10 is stretched around the third support roller 16, thereby forming a secondary transfer nip. A secondary transfer electric field is formed between the grounded second tension roller 23 and the third support roller 16 applied with the secondary transfer bias, around the secondary transfer nip.

Referring back to FIG. 1, the image forming section 100 includes a conveyance path 48 to sequentially convey the recording sheet 5 fed from the sheet feed device 200 or the manual tray 6 to the secondary transfer nip, a fixing device 25 described later, and to an ejection roller pair 56. Further, another conveyance path 49 is disposed to convey the recording sheet 5 conveyed from the sheet feed device 200 to the image forming section 100, and to an entrance to the conveyance path 48. A registration roller pair 47 is disposed at the entrance to the conveyance path 48.

When a print job is started, the recording sheet 5 fed out from the sheet feed device 200 or the manual tray 6 is conveyed toward the conveyance path 48, and abuts the registration roller pair 47. The registration roller pair 47 starts rotation at a proper timing, thereby sending the recording sheet 5 toward the secondary transfer nip. The four-color superimposed toner image on the intermediate transfer belt 10 is secondarily transferred en bloc onto the surface of the recording sheet 5 due to effects of secondary transfer electric field and nip pressure, so that a full-color toner image is formed on the surface of the recording sheet 5.

The recording sheet 5 that has passed through the secondary transfer nip is then conveyed toward the fixing device 25 by the conveyance belt 24. The recording sheet 5 is pressed and heated inside the fixing device 25, so that a full-color toner image is fixed onto the surface of the recording sheet 5. Thereafter, the recording sheet 5 is discharged from the fixing device 25, is ejected by the ejection roller pair 56, and is stacked on the stack tray 7.

Figure 6A:
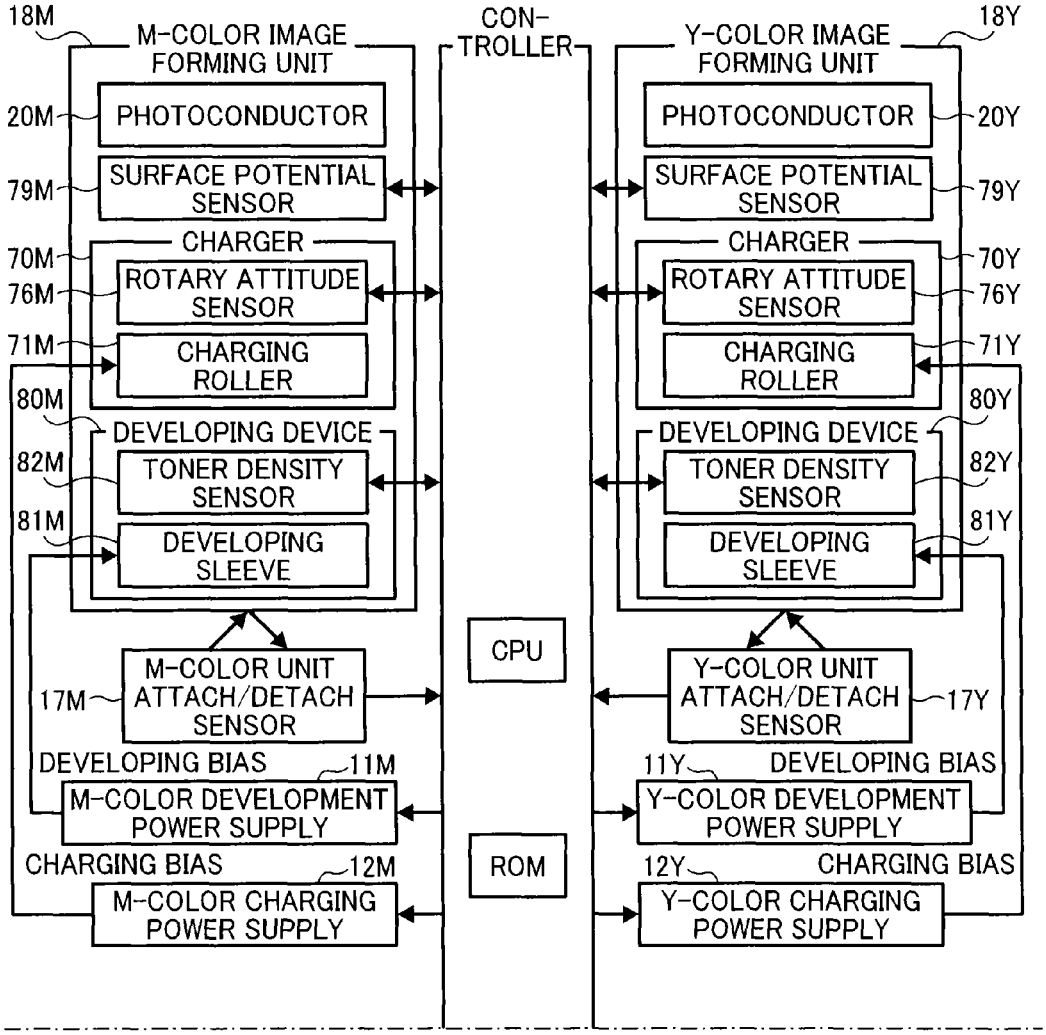
FIGS. 6A and 6B (collectively referred to as FIG. 6) are a block diagram split into two parts, illustrating a principal part of electrical circuit of the copier.
Figure 6B:
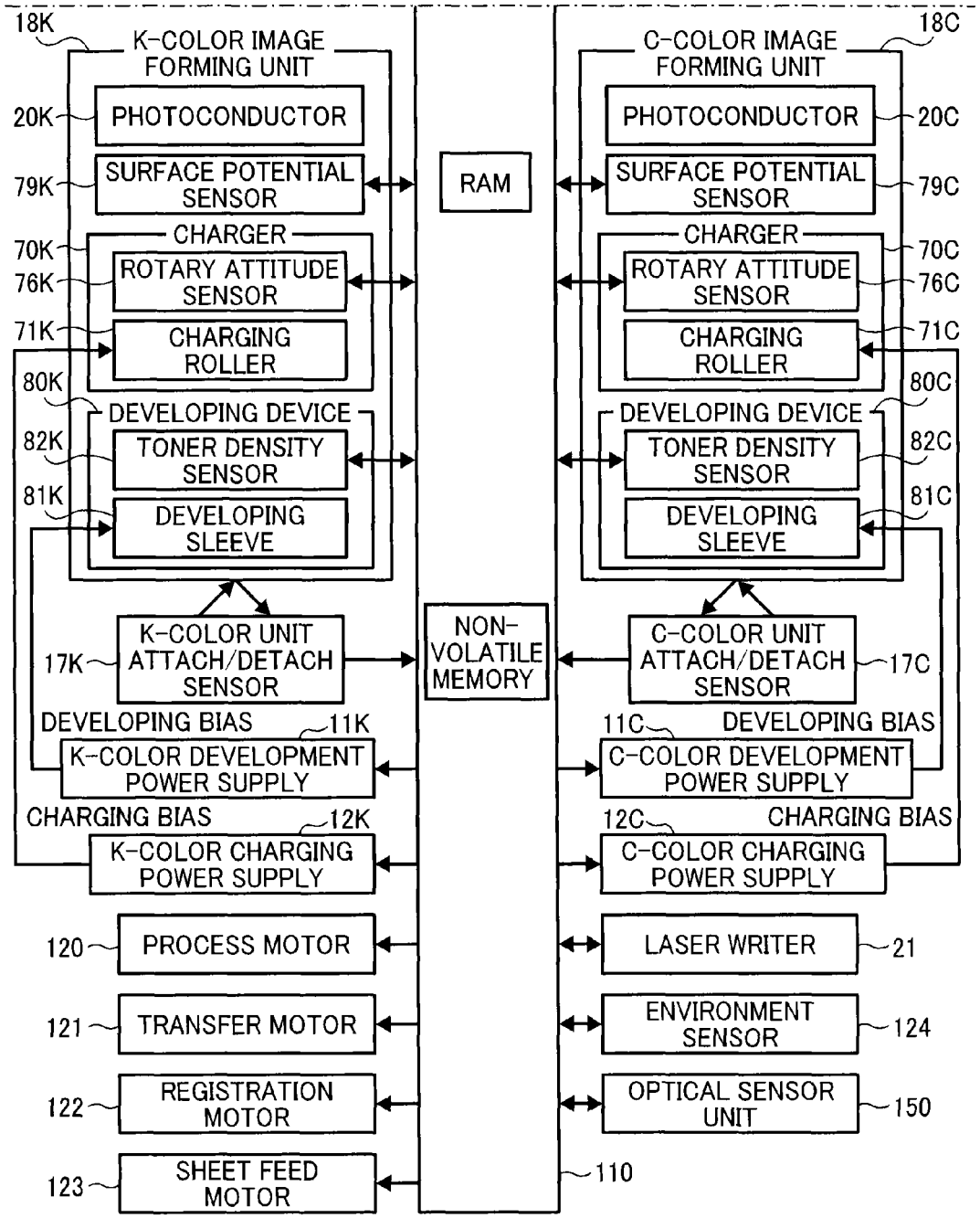

FIGS. 6A and 6B are a block diagram split into two parts for the purpose of convenience, illustrating a principal part of the electrical circuit of the copier 1. In the same figure, the controller 110 includes a CPU, a RAM, a ROM, a nonvolatile memory, and the such. The toner density sensors 82Y, 82C, 82M, and 82K of the Y-, C-, M-, and K-color developing devices 80Y, 80C, 80M, and 80K, respectively, are electrically connected to the controller 110. With this structure, the controller 110 recognizes each toner density of the Y-developer, C-developer, M-developer, and K-developer each contained in the developing devices 80Y, 80C, 80M, and 80K.

Y-, C-, M-, and K-color unit attachment and detachment sensors 17Y, 17C, 17M, and 17K are also electrically connected to the controller 110. The unit attachment and detachment sensors 17Y, 17C, 17M, and 17K detect whether or not any of the image forming units 18Y, 18C, 18M, and 18K, is attached to or detached from the image forming section 100. With this structure, the controller 110 recognizes that the image forming units 18Y, 18C, 18M, and 18K are attached to or detached from the image forming section 100.

In addition, Y-, C-, M-, and K-color development power supplies 11Y, 11 C, 11 M, and 11K are also electrically connected to the controller 110. Because the controller 110 outputs a control signal to each of the development power supplies 11Y, 11C, 11M, and 11K individually, the controller 110 can adjust an amount of the developing bias output from the development power supplies 11Y, 11C, 11M, and 11K, individually. Specifically, an amount of the developing bias to be applied to the Y-, C-, M-, and K-color developing sleeves 81Y, 81C, 81M, and 81K can be individually adjusted.

In addition, Y-, C-, M-, and K-color charging power supplies 12Y, 12C, 12M, and 12K are also electrically connected to the controller 110. Because the controller 110 outputs a control signal to each of the charging power supplies 12Y, 12C, 12M, and 12K, individually, the controller 110 can adjust an amount of direct current voltage in the charging bias output from the charging power supplies 12Y, 12C, 12M, and 12K, individually. Specifically, the amount of direct current voltage in the charging bias to be applied to the Y-, C-, M-, and K-color charging rollers 71Y, 71C, 71M, and 71K can be individually adjusted.

In addition, the rotary attitude sensors 76Y, 76C, 76M, and 76K each to detect whether or not the Y-, C-, M-, and K-color charging rollers 71Y, 71C, 71M, and 71K take a predetermined rotary attitude are also electrically connected to the controller 110. Accordingly, the controller 110 recognizes whether or not each of the Y-, C-, M-, and K-color charging rollers 71Y, 71 C, 71 M, and 71K assumes a predetermined rotary attitude, based on the output from the rotary attitude sensors 76Y, 76C, 76M, and 76K.

In addition, the surface potential sensors 79Y, 79C, 79M, and 79K to detect each surface potential of the photoconductors 20Y, 20C, 20M, and 20K, respectively, are electrically connected to the controller 110. The controller 110 samples repeatedly the output voltage from the surface potential sensors 79Y, 79C, 79M, and 79K while rotatably driving the photoconductors 20Y, 20C, 20M, and 20K. Accordingly, the controller 110 can recognize charging fluctuation of each of the photoconductors 20Y, 20C, 20M, and 20K in each peripheral direction.

In addition, an optical write unit or laser writer 21, an environment sensor 124, an optical sensor unit 150, a process motor 120, a transfer motor 121, a registration motor 122, a sheet feed motor 123, and the like are also electrically connected to the controller 110. The environment sensor 124 detects temperature and humidity in the apparatus. The process motor 120 is a drive source of the image forming units 18Y, 18C, 18M, and 18K. The transfer motor 121 is a drive source of the intermediate transfer belt 10. The registration motor 122 is a drive source of the registration roller pair 47. In addition, the sheet feed motor 123 is a drive source of a pickup roller 202 that sends the recording sheet 5 from a sheet tray 201 of the sheet feed device 200. The optical sensor unit 150 will be described concerning its role and function later.

In the present copier, to stabilize the image density regardless of environmental changes, process control is performed regularly at predetermined intervals. In the process control, first, Y-color patch pattern images including a plurality of patch-shaped Y-toner images are formed on the Y-color photoconductor 20Y, and transferred to the intermediate transfer belt 10. Similarly, C-, M-, and K-color patch pattern images are formed on each of the photoconductors 20C, 20M, and 20K, and transferred on the intermediate transfer belt 10 so as not to overlap. The optical sensor unit 150 detects a toner adhesion amount of each toner image in the patch pattern images. Then, based on the detected results, image forming conditions such as the developing bias Vb for each of the image forming units 18Y, 18C, 18M, and 18K are individually adjusted.

The optical sensor unit 150 includes four reflection-type photosensors disposed at predetermined intervals in the belt width direction of the intermediate transfer belt 10. Each reflection-type photosensor outputs a signal corresponding to an optical reflectivity of the intermediate transfer belt 10 or the patch-shaped toner image disposed on the intermediate transfer belt 10. Three of the four reflection-type photosensors receive both specular reflected light and diffused reflection light on the surface of the belt so that these photosensors output signals corresponding to the Y-, M-, and C-toner adhesion amounts, and outputs signals corresponding to respective received light quantity. The remaining one reflection-type photosensor receives the specular reflected light alone on the surface of the belt so as to output signals corresponding to the K-toner adhesion amount, and outputs signals corresponding to the received light quantity.

The controller 110 performs the process control at predetermined times, such as power-on time for a main power supply, standby after a predetermined time has elapsed, and standby after a predetermined number of prints are executed. When the process control is started, first, the controller 110 obtains information such as a number of prints, image coverage, temperature, and humidity, so that the controller 110 recognizes individual development properties of the image forming units 18Y, 18C, 18M, and 18K. Specifically, the controller 110 calculates development $\gamma$ and development start voltage for each color. More specifically, the controller 110 allows the chargers 70Y, 70C, 70M, and 70K to uniformly charge each surface of the photoconductors 20Y, 20C, 20M, and 20K. In charging, the charging bias output from the charging power supplies 12Y, 12C, 12M, and 12K is different from that output in normal printing. More specifically, among the direct current voltage and the alternating current voltage of the charging bias formed of superimposed bias, an absolute value of the direct current voltage is not constant, but gradually is increased. Using the photoconductors 20Y, 20C, 20M, and 20K charged in the above condition, the laser writer 21 scans each surface of the photoconductors 20Y, 20C, 20M, and 20K with laser beams, so that a plurality of electrostatic latent images for each of the patch-shaped Y-, C-, M-, and K-toner images is formed. The thus-formed latent images are developed by the developing devices 80Y, 80C, 80M, and 80K, respectively, so that the Y-, C-, M-, and K-patch pattern images are formed on the photoconductors 20Y, 20C, 20M, and 20K, respectively. In the development, the controller 110 causes the absolute value of the developing bias to be applied to the Y-, C-, M-, and K-color developing sleeves 81Y, 81C, 81M, and 81K to gradually increase.

Figure 7:
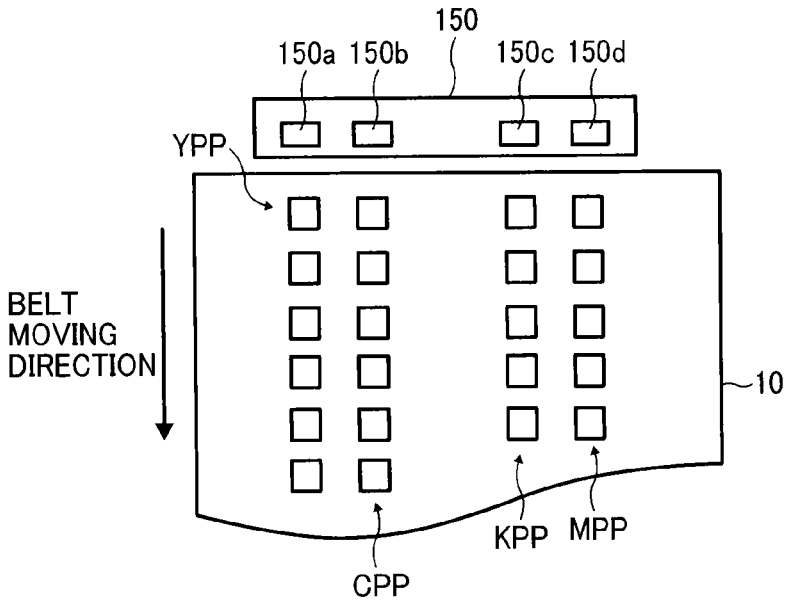
FIG. 7 illustrates patch pattern images transferred to an intermediate transfer belt of the image forming section of the copier.

The Y-, C-, M-, and K-patch pattern images are arranged in the belt width direction so as not to overlap on the intermediate transfer belt 10 each other as illustrated in FIG. 7. Specifically, the Y-patch pattern image YPP is transferred to one end in the width direction of the intermediate transfer belt 10. Similarly, the C-patch pattern image CPP is transferred at a position shifted a little toward the center in the belt width direction than the YPP. In addition, the M-patch pattern image MPP is transferred to the other end in the width direction of the intermediate transfer belt 10. Similarly, the K-patch pattern image KPP is transferred at a position shifted a little toward the center in the belt width direction than the MPP.

The optical sensor unit 150 includes a first reflection-type photosensor 150*a*, a second reflection-type photosensor 150*b*, a third reflection-type photosensor 150*c*, and a fourth reflection-type photosensor 150*d*, and each detecting light reflectivity of the belt at a different position in the belt width direction. Among four reflection-type photosensors, the third reflection-type photosensor 150*c* employs an optics to detect specular reflected light alone, so as to detect a change in the light reflectivity from the surface of the belt due to adhesion of the black toner. By contrast, the other reflection-type photosensor may employ an optics to detect both the specular reflected light and the diffused reflection light so as to detect a change in the light reflectivity from the surface of the belt due to adhesion of the Y-, C-, or M-toner.

The first reflection-type photosensor 150*a* is disposed at a position to detect the Y-toner adhesion amount of the patch-shaped Y-toner image of the Y-patch pattern image YPP formed at the end of the intermediate transfer belt 10 in the belt width direction. The second reflection-type photosensor 150*b*, the fourth reflection-type photosensor 150*d*, and the third reflection-type photosensor 150*c* are disposed each at a position to detect the C-, M-, or K-toner adhesion amount of the C-, M-, or K-patch pattern image CPP, MPP, or KPP formed respectively on the intermediate transfer belt 10 in the belt width direction. Three of the fourth reflection-type photosensors, that is, the first reflection-type photosensor 150*a*, the second reflection-type photosensor 150*b*, and the fourth reflection-type photosensor 150*d*, can detect the toner adhesion amount if the color of the toner is either Y, C, and M, other than black.

The controller 110 calculates light reflectivity of the patch-shaped toner image of respective colors, based on the output signal sequentially sent from the four reflection-type photosensors of the optical sensor unit 150, obtains the toner adhesion amount based on the calculation result, and stores the obtained amount in the RAM. The patch pattern images of respective colors that have passed through the position opposite the optical sensor unit 150 together with the rotation of the intermediate transfer belt 10 are cleaned by the cleaning device from the outer surface of the belt.

The controller 110 calculates a linear approximation formula Y=axVb+b, based on the toner adhesion amount stored in the RAM, and potential data of the exposure unit (that is, the potential of the latent image) stored in the RAM separately from the toner adhesion amount data. Specifically, the linear approximation formula represents a relation between the toner adhesion amount represented on the Y-axis and the development potential represented on the X-axis in an X-Y coordinate system. The controller 110 obtains the developing bias to achieve a target toner adhesion amount based on the linear approximation formula, and stores the obtained result in the nonvolatile memory. The controller 110 performs calculation and storage as to each color of Y, C, M, and K, and terminates its process control. Thereafter, the controller 110 causes the development power supplies 11Y, 11C, 11M, and 11K to output the voltage having the same amount of the developing bias stored in the nonvolatile memory in the print job.

The controller 110 performs the series of process control as described above, so that the image density of the images can be stable over a long period as to each color of Y, C, M, and K. However, image density fluctuation due to the charging fluctuation of the photoconductors 20Y, 20C, 20M, and 20K may be caused if each part of the image is focused. Specifically, the charging rollers 71Y, 71 C, 71 M, and 71K having variations in the resistance on the peripheral surface of the roller, may cause each charged surface of the photoconductors 20Y, 20C, 20M, and 20K to be varied in its peripheral direction and image density of the formed image to be varied. In particular, because a gray scale portion such as a highlight portion or a halftone portion tends to be affected by the charged potential of the photoconductor relative to the image density, the aforementioned image density fluctuation worsens.

Then, the controller 110 performs bias changing process as to each color of Y, C, M, and K in the print job, as follows. Specifically, the controller 110 changes output amount of the direct current voltage from the charging power supplies 12Y, 12C, 12M, and 12K based on the output from the rotary attitude sensors 76Y, 76C, 76M, and 76K and the change pattern data for the Y-, C-, M-, and K-color stored in the nonvolatile memory.

The bias changing process will be described in more detail.

Figure 8:
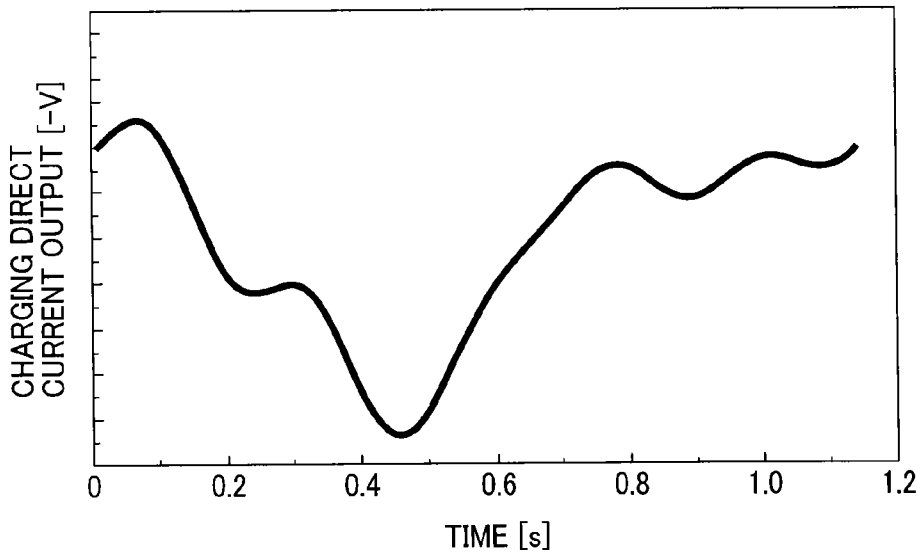
FIG. 8 is a graph showing a change over time in the direct current output for the charging in one cycle of the charging roller.

For example, as change pattern data for the Y-color, suppose that Y-bias change data table to be reproducible as a graph as illustrated in FIG. 8 is stored in the nonvolatile memory. In the same figure, the vertical axis of the graph represents charging direct current output [−V] as a direct current voltage amount for the charging bias output from the charging power supply 12Y. In the present copier, for the surface of the photoconductor 20Y to be charged at a negative polarity, negative polarity voltage is employed as direct current voltage to be superimposed on the alternating current component of the charging bias. The horizontal axis of the graph represents elapsed time period [s]. In the present copier, the charging roller 71Y rotates at a cycle of approximately 1.15 [s]. FIG. 8 shows a change over time in the direct current output [−V] for charging in one cycle of 1.15 seconds. The controller 110 controls the charging power supply 12Y to have such a change over time appear. In the X-axis of the graph of FIG. 8, the time point of 0 second corresponds to an instance when the output voltage from the rotary attitude sensor 76Y drops from 6 volts to zero at once. Y-bias change data table stored in the nonvolatile memory enables reproduction of a change over time of the graph of FIG. 8. For example, when the time point is 0 millisecond, the charging direct current output is minus 510 volts; when the time point is 1 millisecond, the charging direct current output is minus 513 volts; and when the time point is 2 milliseconds, the charging direct current output is minus 515 volts, so that each time point and the corresponding charging direct current output are associated and stored in the table. Such a Y-bias change data table is formulated based on the variations in the resistance of the charging roller 71Y in the peripheral direction, and is stored in the nonvolatile memory.

Upon the controller 110 detecting a rise of the output voltage from the rotary attitude sensor 76Y after the start of a print job, the controller 110 reads a leading data (that is, the charging direct current output corresponding to the time point at 0 (zero) second) of the Y-bias change data table. The controller 110 controls the charging power supply 12Y to output the direct current voltage having the same amount as that of the read result. When, for example, one millisecond has passed, the controller 110 reads second data (that is, the charging direct current output corresponding to the time point at one millisecond) of the Y-bias change data table. The controller 110 controls the charging power supply 12Y to output the direct current voltage having the same amount as that of the read result. Such a control is repeatedly performed, so that the charging direct current output is changed over time as per one cycle of the charging roller 71Y as shown by the graph of FIG. 8. By reducing the fluctuation of the charged surface of the photoconductor due to the variations in the resistance of the charging roller 71A in its peripheral direction, image density fluctuation can be prevented from occurring.

The controller 110 includes, other than the Y-bias change data table, a C-bias change data table, an M-bias change data table, and a K-bias change data table in the nonvolatile memory. As to the C-, M-, and K-biases, by changing the charging direct current output, the image density fluctuation due to the variations in the resistance of the charging rollers 71C, 71M, and 71K in their peripheral directions can be prevented from occurring.

The conventional image forming apparatus formulates the bias change data table to allow the charging bias to change at a predetermined pattern in one cycle of the charging roller, as follows. Specifically, the charging roller is kept away from the photoconductor and is allowed to contact a conductive roller. Next, after the charging roller starts rotation, the attitude of the charging roller is detected by a rotary attitude sensor, and if it is detected that the charging roller assumes a predetermined rotary attitude, a predetermined bias voltage is applied to the charging roller. Then, variations in the resistance of one cycle of the charging roller are obtained based on a change in current strength flowing between the charging roller and the conductive roller; and a bias change data table corresponding to one cycle of the roller according to the variations in the resistance is formulated.

In the above structure to formulate the bias change data table, without detecting the variations in the resistance of the charging roller with a high precision, the charging fluctuation on the surface of the photoconductor is not obtained with a high precision, thereby preventing effective suppression of image density fluctuation.

The controller 110 formulates the Y-bias change data table, the C-bias change data table, the M-bias change data table, and the K-bias change data table, and regularly stores updated data tables in the nonvolatile memory.

In the data formulating process, surface potentials of each of the photoconductors for the colors of Y, C, M, and K are sampled after an activation of the apparatus by driving various devices. Specifically, while rotating the charging rollers 71Y, 71C, 71M, and 71K and the photoconductors 20Y, 20C, 20M, and 20K, the controller 110 causes the charging bias having a constant charging direct current output amount to be output from the charging power supplies 12Y, 12C, 12M, and 12K. Herein, the charging direct current output amount is set to minus 550 volts, for example. In addition, the developing bias of minus 40 volts is applied to each of the developing sleeves 81Y, 81C, 81M, and 81K, and solid latent image is optically written with a light intensity that equals to 70%. Under these conditions, the surface potential sensors 79Y, 79C, 79M, and 79K each detect a surface potential of plural positions of the charging rollers 71Y, 71C, 71M, and 71K in the rotation direction, and the detection result is stored in the RAM. More specifically, each time one millisecond has elapsed, the detection results of the surface potential by the surface potential sensors 79Y, 79C, 79M, and 79K are stored in the RAM. In addition, from immediately after the start of the sampling, the output voltage from the rotary attitude sensors 76Y, 76C, 76M, and 76K is observed, and the time point when the output voltage drops (which is called as a reference attitude timing) is stored in the RAM. Such a process is performed for a period of at least ten cycles of the charging rollers 71Y, 71C, 71M, and 71K.

Figure 9:
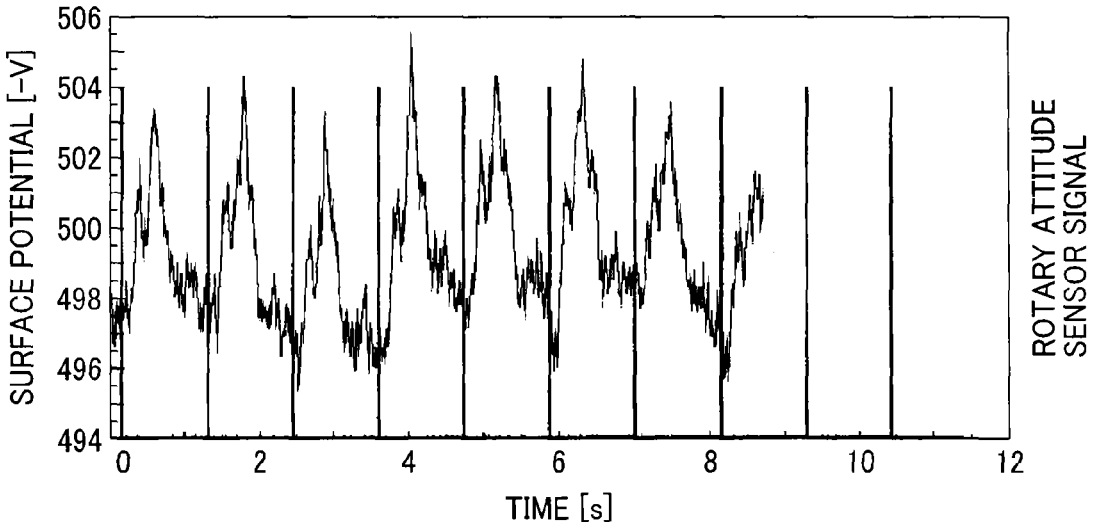
FIG. 9 is a graph showing a surface potential of the photoconductor and reference attitude timing based on surface potential sampling data and reference attitude sampling data obtained by an image forming unit for Y-color.

The controller 110 obtains, through these samplings, the surface potential sampling data and the reference attitude sampling data for each of Y, C, M, and K. FIG. 9 is a graph showing the surface potential of the photoconductor and reference attitude timing based on the surface potential sampling data and the reference attitude sampling data obtained by the image forming unit 18Y for Y-color. In FIG. 9, pulse waveforms of the rotary attitude sensor signal appear periodically; however, in actuality, the pulse waveforms instantaneously rise after the sensor output voltage drops from 6 volts to around zero volt. In the same figure, the status of such output voltage is represented by pulse waveforms for a purpose of convenience. One cycle of the charging roller 71Y is from a rise time of the pulse waveform to immediately before the next rise time of the pulse waveform. In the sampling of the surface potential, as illustrated in FIG. 9, detection results of the surface potential of more than 10 cycles of the charging roller 71Y are sampled in a sequential order.

It is understood that the surface potential of the photoconductor 20Y changes in a pattern synchronizing with one cycle of the charging roller. This change mainly depends on the variations in the resistance of the charging roller 71Y in its peripheral direction. If the surface potential varies as such, a potential of the electrostatic latent image becomes unstable in the gray scale portion such as a highlight portion or a halftone portion that does not obtain a saturated exposure in the image, thereby causing the image density fluctuation. The surface potential sampling data and the reference attitude sampling data obtained for the image forming unit 18Y for Y-color has been described. As to the other colors of image forming units, the surface potential sampling data and the reference attitude sampling data are stored in the similar manner.

The controller 110 divides the surface potential sampling data for one cycle each of the charging roller concerning each of Y-, C-, M-, and K-color, to thereby formulate ten surface potential cycle data points. Specifically, as illustrated in FIG. 9, the reference attitude sampling data includes ten or more reference attitude timings from the start of sampling to the end. If there is a cyclic phase difference between the charging and the potential detection time, those ten or more reference attitude timings are shifted by a predetermined time in accordance with the cyclic phase difference.

Referring back to FIG. 3, a portion of the photoconductor 20Y that reaches a position opposite the charging roller 71Y among the whole periphery of the photoconductor 20Y is defined as a "reference position." The surface potential of the "reference position" is detected when the photoconductor 20Y is charged by the charging roller 71Y, and the reference position moves to the position opposite the surface potential sensor 79Y. Thus, there is a time lag between the charging and the potential detection. Suppose that the time lag corresponds to just one cycle of the charging roller. In this case, a timing that the previous reference position reaches the position opposite the surface potential sensor 79Y in the periphery of the photoconductor 20Y and another timing that the next reference position reaches the position opposite the charging roller 71Y are synchronized. This means that the reference attitude timing and the surface potential detection timing are synchronized, with a time lag of just one cycle. In this case, among the plurality of surface potential data included in the surface potential sampling data, the surface potential data synchronized with the reference attitude timing can be recognized as the data obtained at the reference attitude timing.

Moreover, the surface potential data can be similarly handled if the time lag is an integral multiple of one cycle of the charging roller. In contrast, when the time lag is not an integral multiple of one cycle of the charging roller, the remainder that cannot be divided by an integer becomes a periodic phase difference. Accordingly, by shifting each of the more than ten reference attitude timings included in the reference attitude sampling data by a time corresponding to the periodic phase difference, the reference attitude sampling data and the surface potential sampling timing can be normalized.

The controller 110 shifts the reference attitude timing of more than ten times included in the reference attitude sampling data in accordance with the periodic phase difference, and excludes surface potential cycle data obtained before the first reference attitude timing from the surface potential sampling data. The controller 110 sets the surface potential data obtained at the first reference attitude timing as leading data, and removes the data obtained until immediately before an arrival of the second reference attitude timing as the first cycle surface potential cycle data from the surface potential sampling data. Next, the controller 110 sets the surface potential data obtained at the second reference attitude timing as leading data, and removes the data obtained until immediately before an arrival of the third reference attitude timing as the second cycle surface potential cycle data from the surface potential sampling data. By repeatedly performing the similar process, the controller 110 finally removes the first to tenth cycle surface potential cycle data from the surface potential sampling data. The controller 110 obtains an average cycle data by averaging those ten surface potential cycle data points.

Figure 10:
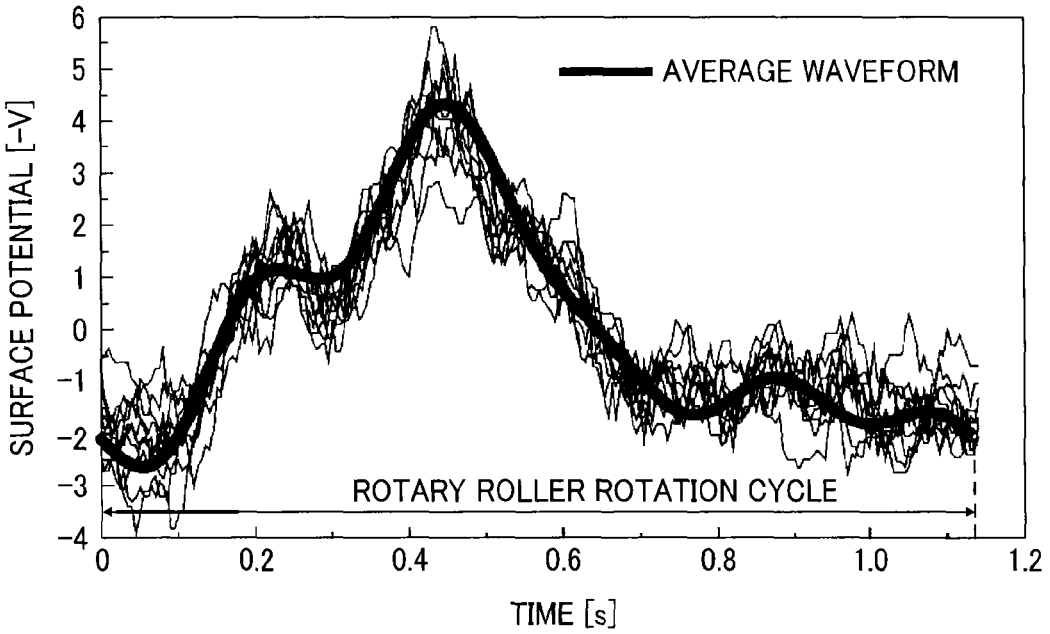
FIG. 10 illustrates average cycle data of ten surface potential cycle data points.

FIG. 10 illustrates an average cycle data of ten surface potential cycle data points. In FIG. 10, ten thin lines are drawn based on plotted points of each surface potential data in the ten surface potential cycle data points, and each line represents outcome of the photoconductor surface potential in one cycle of charging roller. Because the ten lines overlap in many portions, the surface potential fluctuation generated by the charging roller cycle represents high reproducibility. The portions where each line does not overlap are due to noise, so that those portions preferably are removed. The noise can be removed by obtaining an average cycle data of the ten surface potential cycle data points. Specifically, first, each leading data or the first surface potential data is extracted from the ten surface potential cycle data points, and an average value of the leading data is stored as leading data of the average cycle data. Next, second data is extracted from the ten surface potential cycle data points, and the average value is obtained and stored as the second data of the average cycle data. Similarly, the same calculation is performed up to the tail end data to complete the average cycle data. The bold line in FIG. 10 is drawn based on plotted points of individual surface potential data in the average cycle data.

Figure 11:
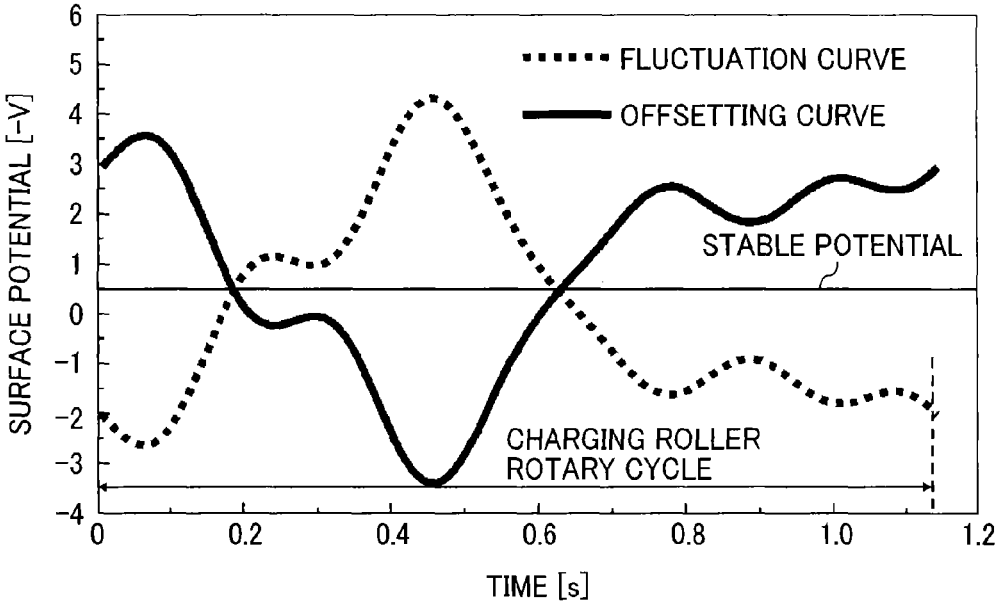
FIG. 11 is a graph showing an exemplary relation among fluctuation curve, offsetting curve, and stable potential of the surface potential of the photoconductor.

FIG. 11 is a graph to show an exemplary relation among a fluctuation curve, an offsetting curve, and a stable potential of the surface potential of the photoconductor. The fluctuation curve is the same as the average curved line of the average cycle data in FIG. 10 and represents fluctuations in the surface potential of the photoconductor occurring in the charging roller cycle. When the offsetting curve is superimposed on the fluctuation curve, a line extending straight at a stable potential is obtained. Specifically, by normalizing the offsetting curve, the surface potential on the photoconductor can be stabilized at a stable potential. Then, the controller 110 formulates a bias change data table to normalize the offsetting curve (or the fluctuation curve of the charging direct current output) based on the average cycle data as to each color of Y, C, M, and K. If the target copier is configured such that the change rate of the charging direct current output of the charging bias and that of the surface potential on the photoconductor are completely the same, the data table that can realize the offsetting curve as illustrated in FIG. 11 is used as is for the bias change data table. However, the change rates normally tend to differ due to responsiveness of the sensor detection, output from power supplies, and the charging. For example, an amplitude of the potential fluctuation detectable by the surface potential sensor narrows as the potential fluctuation frequency of the detection target gets higher. In addition, the amplitude of the output from the charging power supplies narrows as the frequency of the fluctuation cycle of the charging direct current output gets higher. In addition, the charged potential of the photoconductor gets smaller than the charging direct current output as the fluctuation cycle of the charging direct current output gets wider. For these reasons of responsiveness, the change rate of the surface potential of the photoconductor and that of the charging direct current output get out of alignment with each other. As a result, in accordance with the shift rate, the data table capable of realizing the curve obtained by multiplying a predetermined gain on the as-illustrated offsetting curve is formulated as the bias change data table. For example, each data in the data table realizing the offsetting curve is multiplied by three, and the thus-obtained data may be formulated as the bias change data table.

Figure 12:
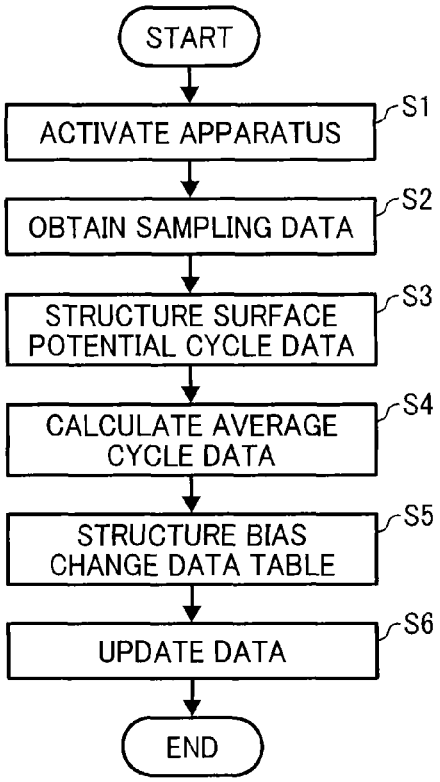
FIG. 12 is a flowchart illustrating a flow of data formulating process performed by a controller of the copier.

FIG. 12 shows a flowchart illustrating a data formulating process performed by the controller 110. When starting the data formulating process, the controller 110 first starts driving various devices to activate the apparatus (in step S1). Herein, the charging direct current output of the charging bias, developing bias, laser write intensity for each color of Y, C, M, and K, are kept constant. In this state, the controller 110 obtains, via sampling the detection result of the photoconductor surface potential and the reference attitude timing for each color of Y, C, M, and K, the surface potential sampling data and the reference attitude sampling data (S2). Next, based on the sampled data, the controller 110 formulates ten surface potential cycle data points for each of Y-, C-, M-, and K-color (S3) and calculates average cycle data of the photoconductor surface potential (S4). The controller 110 formulates the bias change data table based on the average cycle data (S5), and updates data inside the nonvolatile memory to the data after formulation (S6).

As described above, the copier 1 according to the present embodiment can detect the charging fluctuation of the photoconductors 20Y, 20C, 20M, and 20K in the peripheral direction due to variations in the resistance of the charging rollers 71Y, 71C, 71M, and 71K in the peripheral direction, using the surface potential sensors 79Y, 79C, 79M, and 79K. In addition, the present copier can detect the charging fluctuation of the photoconductors 20Y, 20C, 20M, and 20K in the peripheral direction due to the reasons other than variations in resistance. Based on these detection results, the change pattern data to eliminate the charging fluctuation of the photoconductor can be formulated for each color of Y, C, M, and K. With this structure, in addition of the image density fluctuation due to the charging fluctuation of the photoconductor resulting from the variations in the resistance of the charging roller, the image density fluctuation due to the charging fluctuation of the photoconductor resulting from different reasons other than the variations in the resistance can be prevented.

The charging roller (71Y, 71 C, 71 M, or 71K) does not always rotate stably at a designed cycle (for example, 1.15 seconds). Due to errors in the engagement of gears, slipping of the charging roller relative to each of the photoconductors 20Y, 20C, 20M, and 20K, and the like, cyclic rotation deviated from the designed cycle may occur. When the rotation is performed with a longer cycle than the designed cycle, in the bias changing process, after the tail end data of the bias change data table is read and the read data is reflected to the charging direct current output, before the reference attitude timing arrives, a next data read timing arrives. In such a case, suppose that the charging direct current output is kept to be as a previous value until the reference attitude timing arrives. In this case, when the reference attitude timing is not detected in a cycle for some reason, the charging direct current output is not changed in that cycle and is kept constant, which may cause the photoconductor to generate charging fluctuation. To cope with this problem, the controller 110 performs following processes to each color of Y, C, M, and K. Specifically, in the bias changing process, if the next data read time arrives before the reference attitude timing arrives after the tail end data of the bias change data table has been read, a process to return the data read target from the bias change data table to the leading data, is performed. In this structure, when the reference attitude timing is not detected in a cycle for some reason, the charging direct current output is properly changed in that cycle, thereby preventing the image density fluctuation from occurring.

As described above, as to the rotation of the charging rollers 71Y, 71C, 71M, and 71K, not a small number of times of cyclic rotation deviated from the designed cycle occurs. With no relation to the reference attitude timing, suppose that the data is repeatedly read from the bias change data table at a predetermined interval, and the read position is returned to the leading data after the tail end data has been read. Then, each time those cycles are repeatedly performed, the data reading position shifts from a proper position, thereby worsening the charging fluctuation of the photoconductors 20Y, 20C, 20M, and 20K.

To cope with this problem, the controller 110 performs a following process as to each color of Y, C, M, and K. Specifically, each time the rotary attitude sensors 76Y, 76C, 76M, and 76K detect the reference attitude timing, the target for reading data from the bias change data table is returned to the leading data. In this structure, regardless of errors in the rotary cycle of the charging rollers 71Y, 71C, 71M, and 71K, the charging direct current output is changed with a proper pattern and prevents effectively the image density fluctuation from occurring.

In the present copier, following five timings are adopted as regular timings to perform data formulating process.

The first timing is each time a print job of a predetermined number of times is performed. When that timing arrives, if a continuous print job to continuously print images to the plurality of recording sheets is being done, the continuous print job is suspended and the data formulating process is performed. By performing data formulating process each time a predetermined number of print jobs has been done, the image density fluctuation due to the variations in the resistance of the charging roller can be prevented over a long period regardless of the accumulated number of times of print jobs.

The second timing is before the print job after having received a print command from a user. In this case, the data formulating process is performed before starting a print job, so that the image density fluctuation due to the variations in the resistance of the charging roller can be prevented to a stable level even though a long period has passed since the latest print job.

The third timing is immediately after the process control as an adjusting process of image forming conditions is completed. In this case, because the process control has been done and the image forming condition is newly updated, an optimal bias change data table can be formulated.

In addition, the fourth timing is when an environmental change exceeding a threshold is detected within a predetermined time period by the environment sensor 124 serving as an environmental change sensor. An exemplary fourth timing is when the temperature change exceeding 4° C. during a ten-minute period is detected. When the environmental condition changes greatly, the bias change data table does not meet the environment after the change, and the image density fluctuation worsens. In the above case, the effect of reducing the image density fluctuation can be prevented from worsening.

In addition, the fifth timing is when the unit attachment and detachment sensors 17Y, 17C, 17M, and 17K detects that any of the image forming units 18Y, 18C, 18M, and 18K is attached or detached. The bias change data table does not meet a new charging roller due to the replacement of any of the image forming units. But in the above case, the effect of reducing the image density fluctuation can be prevented from worsening The copier 1 according to the embodiments of the present invention is not limited to the embodiments described heretofore, but various modification and change can be applied to the presently embodied invention. For example, the image forming apparatus to which the presently embodied invention may be applied to a printer, a facsimile machine, or a multifunction apparatus, instead of a copier. Further, the presently embodied invention may be applied not only to the image forming apparatus forming a color image, but to a monochrome image forming apparatus that can form monochrome images only. Further, the presently embodied invention may be applied not only to the image forming apparatus forming the image on one side of the recording sheet, but to both sides of the recording sheet, if necessary. Examples of recording sheet include a regular sheet, an OHP sheet, a card, a postcard, a thick sheet, an envelope, and the like. The aforementioned embodiments are examples and specific effects can be obtained for each of the following aspects of (A) to (J):

<Aspect A>

The aspect A relates to a latent image carrier (for example, the photoconductor 20); a charger (for example, the charging roller 71) to charge, while rotating, a surface of the latent image carrier; a charging power supply (for example, the charging power supply 12) to output bias voltage to be applied to the charger; a latent image writer (for example, the laser writer 21) to write a latent image on the surface of the charged surface of the latent image carrier; a developing device (for example, the developing device 80) to develop the latent image to obtain a toner image; a rotary attitude sensor (for example, the rotary attitude sensor 76) to detect whether or not the charger assumes a predetermined rotary attitude; a controller (for example, the controller 110) to perform a data formulating process to formulate a change pattern data (for example, a bias change data table) to cause the charging power supply to change an charging bias output by a predetermined pattern, and to perform a bias changing process to cause the charging power supply to change the charging bias output based on the detection result of the rotary attitude sensor and the change pattern data, during a print job; and a surface potential sensor (for example, the surface potential sensor 79) to detect a surface potential of the latent image carrier, wherein, in the data formulating process, the controller formulates the change pattern data based on a detection result of the surface potentials at a plurality of positions of the latent image carrier in the rotary direction detected by the surface potential sensor while the charging power supply outputting a constant charging bias and a detection result of the rotary attitude sensor while the surface potential is being detected.

As described in the background section, the pattern of the charging fluctuation occurring to the photoconductor by the charging roller rotary cycle and that of the electrical resistance fluctuation in one cycle of the charging roller detected by the resistance sensor are not always the same. For example, the charged potential of the photoconductor receives influences of the electrical resistance of the charging roller, and contact conditions such as an average value of a contact width between the charging roller and the photoconductor, that is, a contacting length in the surface moving direction, or variations of a contacting width and pressure due to eccentricity of the charging roller. Further, even though non-contacting charging method in which the charging roller does not contact the photoconductor is employed, conditions of the opposed member such as curvature radius of the photoconductor opposed to the charging roller, an average value of the gap formed between the charging roller and the photoconductor, and variations of the gap due to the eccentricity of the charging roller may adversely affect the charged potential of the photoconductor. Due to the limitation on the device layout or the dimensional precision, the contacting condition or opposed condition between the charging roller and the conductive roller when the electrical resistance is detected, and the contacting condition or opposed condition between the charging roller and the photoconductor in the printing operation cannot be the same. When the pattern of the charging fluctuation of the charging roller is not detected correctly based on the pattern of the variations in the resistance of the charging roller actually affecting the photoconductor, the image density fluctuation is not sufficiently suppressed.

In contrast to the above drawbacks in the background art, with the present configuration, the charging roller charges the latent image carrier in a state in which the charging roller contacts the latent image carrier in the same contacting condition as in the print job, or alternatively, in a state in which the charging roller positions opposite the latent image carrier in the same opposing condition as in the print job. Thus, the fluctuation of the charged surface of the latent image carrier that is actually generated in the print job can be correctly recognized based on the detection result of the surface potential of the latent image carrier after charging by the surface potential sensor. Based on the recognized result, the controller 110 formulates change pattern data to eliminate the fluctuation of the charged surface, thereby more securely preventing the image density fluctuation.

<Aspect B>

In Aspect A, the aspect B is configured such that the controller causes the charging power supply to output a superimposed voltage in which an alternating current voltage and a direct current voltage are superimposed and formulates the change pattern data to change the direct current voltage (for example, charging direct current output) included in the superimposed voltage. With this structure, by changing the direct current voltage in the charging bias in accordance with the change pattern data, the image density fluctuation due to the variations in the resistance of the charging roller can be suppressed.

<Aspect C>

In Aspects A and B, the aspect C is configured such that the controller formulates the change pattern data of one cycle of the charging roller based on the detection result of the surface potential of an area extending at least a circumferential length of the charging roller among an entire area in the peripheral direction of the surface of the latent image in the data formulating process. With this structure, the image density fluctuation due to the variations in the resistance of the charging roller over the whole peripheral surface thereof can be prevented from being generated.

<Aspect D>

In Aspect C, the aspect D is configured such that, if the rotary attitude sensor detects that the charging roller assumes a predetermined rotary attitude after the tail end data of the bias change data table has been read and before the next data read timing arrives in the bias changing process, the controller is configured to return the data read target from the bias change data table to the leading data. In this structure, when the reference attitude timing is not detected in a cycle for some reason, the charging direct current output is properly changed in that cycle, thereby preventing the image density fluctuation from occurring.

<Aspect E>

In Aspect D, the aspect E is configured such that, in the bias changing process, the controller returns the target for reading data from the change pattern data to the leading data each time the rotary attitude sensors detect that the charging roller assumes a predetermined rotary attitude. In this structure, regardless of the error in the rotary cycle of the charging rollers, the charging direct current output of the charging bias is changed with a proper pattern and the image density fluctuation can be prevented effectively from occurring.

<Aspect F>

In any of Aspects A to G, the aspect F is configured such that the controller performs the data formulating process each time a predetermined number of print jobs has been performed. With this structure, the image density fluctuation due to the variations in the resistance of the charging roller can be prevented regardless of the accumulated number of times of print jobs.

<Aspect G>

In any of Aspects A to F, the aspect G is configured such that the controller performs the data formulating process before starting a print job after receiving a print command. With this structure, the image density fluctuation due to the variations in the resistance of the charging roller can be prevented even though a long period has passed since the latest print job.

<Aspect H>

In any of Aspects A to G, the aspect H is configured such that the controller forms a gray scale pattern image (for example, a patch pattern image) including a plurality of toner images for density detection with different image densities from each other; recognizes a development characteristic (for example, approximation line formula) based on the detection result of an image density (for example, toner adhesion amount) of the plurality of toner images for density detection in the gray scale pattern image; performs an image forming condition adjusting process (for example, a process control) to adjust image conditions based on the recognized result; and performs the data formulating process immediately after the image forming condition adjusting process has been complete. With this structure, because the image forming condition adjusting process has been done and the image forming condition is newly updated, an optimal change pattern data can be formulated.

<Aspect I>

In any of Aspects A to H, the aspect I further includes an environment sensor (for example, the environment sensor 124) to detect an environmental change, and the controller performs the data formulating process when an environmental change exceeding the threshold is detected within a predetermined time period by the environment sensor. When the environmental condition changes greatly, the change pattern data does not meet the environment after the change, and the image density fluctuation worsens. Even in such a case, the effect of reducing the image density fluctuation can be prevented from worsening.

<Aspect J>

In any of Aspects A to I, the aspect J further includes a unit attachment and detachment sensors (for example, the unit attachment and detachment sensors 17Y, 17C, 17M, and 17K) each to detect whether an image forming unit (for example, an image forming unit 18Y, 18C, 18M, or 18K) is attached to or detached from the apparatus, wherein the controller performs the data formulating process when the unit attachment and detachment sensors detect that any of the image forming units is attached or detached. The change pattern data does not meet a new charging roller due to the replacement of any of the image forming units. But in the above case, the effect of reducing the image density fluctuation can be prevented from worsening.

Additional modifications and variations of the present invention are possible in light of the above teachings. It is therefore to be understood that, within the scope of the appended claims, the invention may be practiced other than as specifically described herein.

What is claimed is:

1. An image forming apparatus comprising:

a latent image carrier;

a charging roller to charge, while rotating, a surface of the latent image carrier;

a charging power supply to output bias voltage to be applied to the charging roller;

a latent image writer to write a latent image on the surface of the latent image carrier charged by the charging roller;

a developing device to develop the latent image to obtain a toner image;

a rotary attitude sensor to detect whether or not the charging roller assumes a predetermined rotary attitude;

a controller to perform, at a predetermined timing, a data formulating process to formulate a change pattern data as a bias change data table to cause the charging power supply to change a charging bias output by a predetermined pattern, and to perform a bias changing process to cause the charging power supply to change the charging bias output based on readings from the rotary attitude sensor and the change pattern data, during a print job; and a surface potential sensor to detect a surface potential of the latent image carrier, wherein, in the data formulating process, the controller formulates the change pattern data based on the surface potential at a plurality of positions of the latent image carrier in a rotary direction detected by the surface potential sensor, while the charging power supply outputting a constant charging bias, and based on readings from the rotary attitude sensor while the surface potential is being detected, and wherein the controller formulates the change pattern data of one cycle of the charging roller based on the surface potential of an area extending at least a circumferential length of the charging roller as detected by the surface potential sensor.

2. The image forming apparatus as claimed in claim 1, wherein the charging power supply outputs a superimposed voltage in which an alternating current voltage and a direct current voltage are superimposed, and the controller formulates the change pattern data to change the direct current voltage included in the superimposed voltage.

3. The image forming apparatus as claimed in claim 1, wherein the controller performs a process to return a data read target from the bias change data table to leading data if the rotary attitude sensor detects that the charging roller assumes a predetermined rotary attitude after tail end data of the bias change data table has been read and before the next data read timing in the bias changing process.

4. The image forming apparatus as claimed in claim 3, wherein, in the bias changing process, the controller returns the data read target from the change pattern data to the leading data each time the rotary attitude sensor detects that the charging roller assumes a predetermined rotary attitude.

5. The image forming apparatus as claimed in claim 1, wherein the controller performs the data formulating process each time a predetermined number of print jobs has been performed.

6. The image forming apparatus as claimed in claim 1, wherein the controller performs the data formulating process before starting a print job after receiving a print command.

7. An image forming apparatus comprising:

a latent image carrier;

a charging roller to charge, while rotating, a surface of the latent image carrier;

a charging power supply to output bias voltage to be applied to the charging roller;

a latent image writer to write a latent image on the surface of the latent image carrier charged by the charging roller;

a developing device to develop the latent image to obtain a toner image;

a rotary attitude sensor to detect whether or not the charging roller assumes a predetermined rotary attitude;

a controller to perform, at a predetermined timing, a data formulating process to formulate a change pattern data as a bias change data table to cause the charging power supply to change a charging bias output by a predetermined pattern, and to perform a bias changing process to cause the charging power supply to change the charging bias output based on readings from the rotary attitude sensor and the change pattern data, during a print job; and a surface potential sensor to detect a surface potential of the latent image carrier, wherein, in the data formulating process, the controller formulates the change pattern data based on the surface potential at a plurality of positions of the latent image carrier in a rotary direction detected by the surface potential sensor, while the charging power supply outputting a constant charging bias, and based on readings from the rotary attitude sensor while the surface potential is being detected, wherein the controller is configured to:

form a gray scale pattern image including a plurality of toner images for density detection with different image densities from each other;

recognize a development characteristic showing a relation between an image density and an image forming condition based on a detection result of an image density of the plurality of toner images for density detection in the gray scale pattern image;

perform an image forming condition adjusting process to adjust image conditions based on the recognized development characteristic; and perform the data formulating process immediately after the image forming condition adjusting process has been completed.

8. The image forming apparatus as claimed in claim 1, further comprising an environment sensor to detect environmental change, wherein the controller performs the data formulating process when an environmental change exceeding a threshold is detected by the environment sensor within a predetermined time period.

9. An image forming apparatus comprising:

a latent image carrier;

a charging roller to charge, while rotating, a surface of the latent image carrier;

a charging power supply to output bias voltage to be applied to the charging roller;

a latent image writer to write a latent image on the surface of the latent image carrier charged by the charging roller;

a developing device to develop the latent image to obtain a toner image, a rotary attitude sensor to detect whether or not the charging roller assumes a predetermined rotary attitude;

a controller to perform, at a predetermined timing, a data formulating process to formulate a change pattern data as a bias change data table to cause the charging power supply to change a charging bias output by a predetermined pattern, and to perform a bias changing process to cause the charging power supply to change the charging bias output based on readings from the rotary attitude sensor and the change pattern data, during a print job; and a surface potential sensor to detect a surface potential of the latent image carrier, wherein, in the data formulating process, the controller formulates the change pattern data based on the surface potential at a plurality of positions of the latent image carrier in a rotary direction detected by the surface potential sensor, while the charging power supply outputting a constant charging bias, and based on readings from the rotary attitude sensor while the surface potential is being detected, wherein the image forming apparatus further comprises a unit attachment and detachment sensor to detect whether or not an image forming unit is attached to or detached from the apparatus, and wherein the controller performs the data formulating process when the unit attachment and detachment sensor detects that the image forming unit has been attached or detached.

* * * * *